US005896625A

United States Patent [19]

Tanner

[11] Patent Number: 5,896,625

[45] Date of Patent: Apr. 27, 1999

[54] BRACELET CLASP

[76] Inventor: Brian S. Tanner, P.O. Box 1504, Lunenburg, Nova Scotia, Canada, B0J 2C0

[21] Appl. No.: 08/795,380

[22] Filed: Feb. 4, 1997

[30] Foreign Application Priority Data

Feb. 19, 1996 [CA] Canada ..... 2169790

[51] Int. Cl.[6] ..... A44B 11/00; A44C 11/02

[52] U.S. Cl. ..... 24/71 J; 24/69 J; 24/316; 24/343; 63/3.1; 63/14.4

[58] Field of Search ..... 24/265 EC, 265 H, 24/265 R, 71 J, 71 R, 69 J, 69 R, 68 J, 327, 343, 316; 63/3, 3.1, 1.11, 14.4, 14.8

[56] References Cited

U.S. PATENT DOCUMENTS

| | | | |
|---|---|---|---|
| 1,636,869 | 7/1927 | Schaefer | 24/69 R |
| 2,462,425 | 2/1949 | Pratt et al. | 63/3 |
| 2,596,504 | 5/1952 | Hoeckele | 24/69 J X |
| 4,306,602 | 12/1981 | Nestlen | 24/316 X |

FOREIGN PATENT DOCUMENTS

| | | | |
|---|---|---|---|
| 497319 | 12/1919 | France | 34/69 J |
| 114154 | 3/1926 | Switzerland | 24/71 J |
| 1283783 | 8/1972 | United Kingdom | 24/69 R |

*Primary Examiner*—James R. Brittain
*Assistant Examiner*—Robert J. Sandy
*Attorney, Agent, or Firm*—Achmed N. Sadik

[57] ABSTRACT

A clasp or catch for jewelry items or the like, comprises: a first member, for attachment to one end of a jewelry item, having two parallel sides and two transversal bars interconnecting the two sides; a second generally O-shaped but not closed member having one end pivoting around one of the two transversal bars, and the other end securely engaging the other of the two transversal bars; and a third member, for attachment to another end of the jewelry item, similar in construction to said first member, having at least one cross bar for retaining said other end of the second member when not engaged by said other of the two transversal bars.

1 Claim, 1 Drawing Sheet

BRACELET CLASP

BACKGROUND OF THE INVENTION

1. Field of the Invention

The present invention is directed to items of jewelry in general, and in particular to a clasp or catch for securing such items on the wearer. The clasp is easy to operate, and offers improved security even in the open position such that if inadvertently opened the bracelet or necklace would not necessarily drop off the wearer.

2. Prior Art of the Invention

Known prior art are the ubiquitous clasps or catches known in the trade by the names "spring ring", "lobster claw", and "box catch". They are generally difficult to manipulate and close with one hand, and when open have their ends fully disengaged.

The spring ring and lobster claw catches require the wearer to chase the open end of a bracelet while at the same time operating the spring mechanism of the catch. The box catch requires the wearer to push two loose ends toward each other with one hand.

SUMMARY OF THE INVENTION

The present invention provides an improved yet simple clasp (or catch) having a single pivot and no springs or other smaller parts. It has essentially four positions: fully securely engaged; intermediate but retained; open but retained; and fully disengaged. If inadvertently or accidentally opened while the wearer is unaware, it will mostly end up in the open but retained position. Moreover, while in the fully securely engaged position, pulling at both ends of the clasp would not cause it to disengage.

According to the invention, a clasp or catch for jewelry items or the like, comprises: a first member, for attachment to one end of a jewelry item, having two parallel sides and two transversal bars interconnecting the two sides; a second generally O-shaped but not closed member having one end pivoting around one of the two transversal bars, and the other end securely engaging the other of the two transversal bars; and a third member, for attachment to another end of the jewelry item, similar in construction to said first member, having at least one cross bar for retaining said other end of the second member when not engaged by said other of the two transversal bars.

In a narrower aspect, a clasping assembly adapted for clasping an item of jewelry or the like, comprises: a first anchoring member having an attachment point at its proximal end, and presenting a clasping portion; said clasping portion having two generally parallel sides, and first and second transversal bars connecting the two sides, said second bar being located in the vicinity of the distal end of the clasping portion; a clasping member rotatably and hingedly fixed to the second bar of the first anchoring member; said clasping member being adapted to cooperate with a second anchoring member; said second anchoring member having an attachment point at its proximal end, and a transversal bar at its distal end; said clasping member being rotatably movable from a first clasping position to a second, loosely holding position; said clasping member comprising a stiff flexible metal band hinged at one end to the second bar of the first anchoring member, and extending longitudinally to pass under and around the transversal bar on the second anchoring member, and extending longitudinally past the hinge point, and terminating in a springing hook portion adapted to cooperate with the first traverse bar on the first anchoring member when disposed in the clasping position; and when the clasping member is springedly detached from the first transverse bar said clasping member being rotatable to a second position where the hook loosely engages the transverse bar on the second clasping member; and whereby the jewelry is tightly clasped when the clasping assembly is disposed in the clasping position, and is loosely removably retained in place when the clasping assembly is released to the loosely holding position.

BRIEF DESCRIPTION OF THE DRAWINGS

The preferred embodiment of the present invention will now be described in detail in conjunction with the drawings, in which.

DETAILED DESCRIPTION OF THE PREFERRED EMBODIMENT

Figure 1:
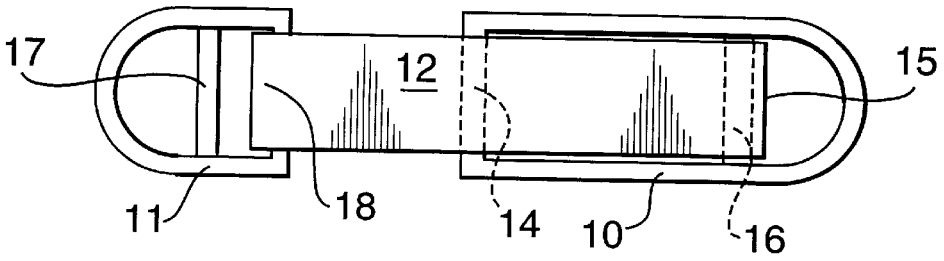
FIG. 1 is a plan view of the clasp of the present invention in the fully securely engaged (closed) position.
Figure 2:
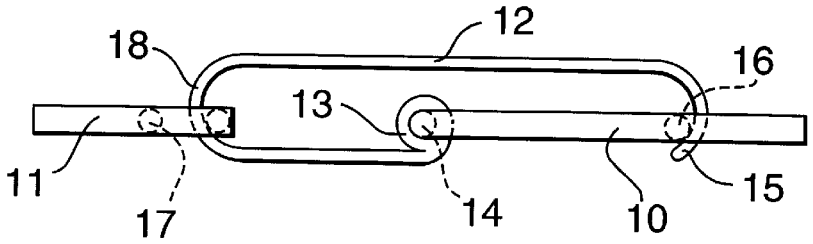
FIG. 2 is a side view of the clasp as shown in FIG. 1.
Figure 3:
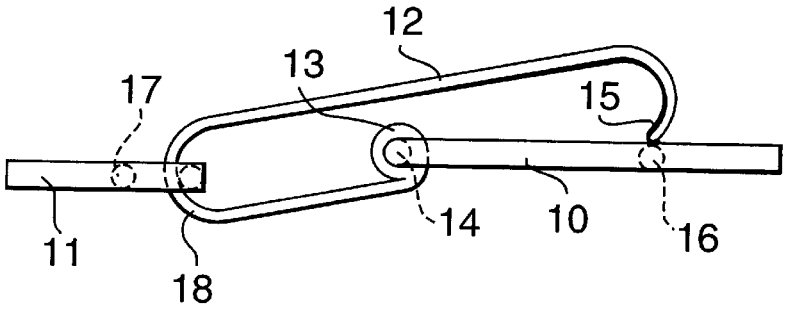
FIG. 3 is a side view of the clasp in an intermediate, partially open position.
Figure 4:
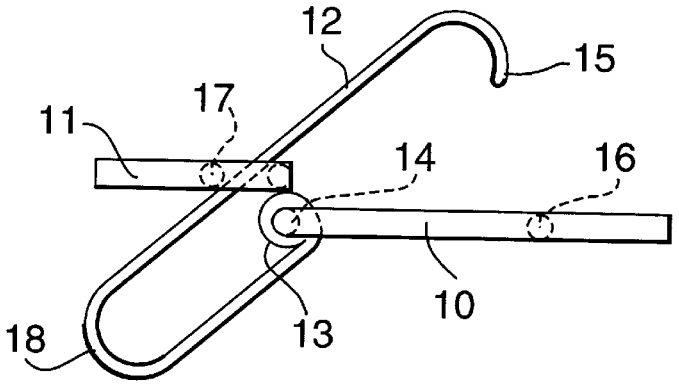
FIG. 4 is a side view of the clasp as shown in FIG. 3 travelling further toward the open position.
Figure 5:
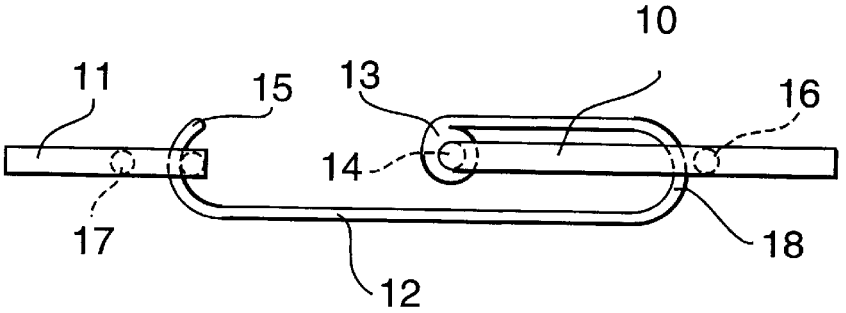
FIG. 5 is a side view of the clasp in the open but retained position.

With reference to FIGS. 1 to 5 of the drawings, the clasp comprises first and second generally rectangular attachment or anchoring members 10 and 11, with their distal ends adapted for attachment to the ends of a bracelet or the like. Bridging the gap between the member 10 and 11 and overlapping their distal ends is a clasping member 12, which is made of a stiff, flexible metal sheet. As may be seen in FIGS. 2 to 5, the clasping member 12 is a flattened partial "O" shaped from a rectangular band, one end 13 of which pivots around a proximal transversal bar 14, which the other end 15 of which clasps a distal transversal bar 16 of the member 10. The member 11 also has a distal bar 17 in order to prevent the clasping end 15 of the clasping member 12 from easily disengaging when not in the clasped position, as may be seen in the intermediate position shown in FIG. 4. In the open but retained position shown in FIG. 5, the abutment of the U-shaped end 18 of the clasping member 12 against the distal bar 16 prevents the clasping end 15 from easily disengaging beyond the proximal edge of the member 11. Thus, the wearer must bring both member 10 and 11 closer together to cause the clasp to fully open.

What is claimed is:

1. A clasp or catch for jewelry items or the like, comprises:

a first member, for attachment to one end of a jewelry item, having two parallel sides and two transversal bars interconnecting the two sides;

a second clasping member, being a flattened partial "O" shaped from a rectangular band, having two ends, one end pivoting around one of the two transversal bars and having it as axis of rotation, and the other end securely clasping the other of the two transversal bars; and a third member, for attachment to another end of the jewelry item, having at least one cross bar for retaining the other end of the second clasping member when not securely clasping said other one of the two transversal bars.

* * * * *